US009651915B2

(12) United States Patent
Morgan

(10) Patent No.: US 9,651,915 B2
(45) Date of Patent: May 16, 2017

(54) PROCESS CARTRIDGE MODIFICATION AND METHOD FOR RETRACTABLE PROCESS CARTRIDGE DRIVE

(71) Applicant: CLOVER TECHNOLOGIES GROUP, LLC, Ottawa, IL (US)

(72) Inventor: John Morgan, Newbury Park, CA (US)

(73) Assignee: CLOVER TECHNOLOGIES GROUP, LLC, Ottawa, IL (US)

( * ) Notice: Subject to any disclaimer, the term of this patent is extended or adjusted under 35 U.S.C. 154(b) by 0 days.

(21) Appl. No.: 15/061,391

(22) Filed: Mar. 4, 2016

(65) Prior Publication Data

US 2016/0259295 A1 Sep. 8, 2016

Related U.S. Application Data

(60) Provisional application No. 62/128,769, filed on Mar. 5, 2015.

(51) Int. Cl.
*G03G 15/00* (2006.01)
*G03G 21/18* (2006.01)

(52) U.S. Cl.
CPC ..... *G03G 21/181* (2013.01); *G03G 15/757* (2013.01); *G03G 21/186* (2013.01); *G03G 2215/00987* (2013.01); *G03G 2221/1654* (2013.01); *G03G 2221/1657* (2013.01)

(58) Field of Classification Search
CPC ..... G03G 21/181; G03G 2215/00987; G03G 21/1857; G03G 21/186; G03G 21/1864; G03G 2221/1657; G03G 15/757; G03G 2221/1654
USPC ..... 399/109
See application file for complete search history.

(56) References Cited

U.S. PATENT DOCUMENTS 5,528,341 A 6/1996 Shishido et al.
5,675,893 A * 10/1997 Yamada ..... B21D 39/04 29/895.2
6,844,890 B1 * 1/2005 Morgan ..... G03G 15/0855 347/228
8,121,517 B2 2/2012 Asanuma et al.
9,170,549 B2 10/2015 Wang
2002/0159787 A1 * 10/2002 Chadani ..... G03G 21/181 399/109
2006/0159485 A1 * 7/2006 Nishimura ..... G03G 15/0894 399/109
2008/0240796 A1 * 10/2008 Morioka ..... F16D 1/10 399/279
2009/0010681 A1 * 1/2009 Huck ..... F16D 1/101 399/167
2009/0162093 A1 * 6/2009 Shanun ..... G03G 15/757 399/109
2009/0317132 A1 * 12/2009 Asanuma ..... G03G 21/1853 399/117

(Continued)

OTHER PUBLICATIONS

European Search Report and Written Opinion, European Application No. EP16158798, Oct. 12, 2016, 9 pages, European Patent Office, Munich, Germany 80298.

*Primary Examiner* — Francis Gray
(74) *Attorney, Agent, or Firm* — Matthew G. Gavronski

(57) ABSTRACT

A modification for an imaging cartridge is provided for use with certain aftermarket or non-OEM cartridge drive mechanisms. At least one wall of a cartridge guiding member is removed to increase a clearance between the guiding member and the cartridge drive mechanism.

16 Claims, 5 Drawing Sheets

(56) References Cited

U.S. PATENT DOCUMENTS

| | | | | |
|---|---|---|---|---|
| 2010/0034561 | A1* | 2/2010 | Batori | G03G 15/757 399/167 |
| 2010/0142991 | A1* | 6/2010 | Holmes | G03G 21/181 399/109 |
| 2011/0217073 | A1 | 9/2011 | He | |
| 2013/0039675 | A1* | 2/2013 | Holmes | G03G 15/0894 399/109 |
| 2014/0041476 | A1* | 2/2014 | Huang | F16D 3/2052 74/434 |
| 2014/0119778 | A1* | 5/2014 | Morgan | G03G 21/1647 399/167 |
| 2014/0133883 | A1* | 5/2014 | Martin | G03G 15/0894 399/109 |
| 2015/0030353 | A1 | 1/2015 | Wang | |
| 2015/0053033 | A1* | 2/2015 | Niederstadt | F16H 1/10 74/412 R |
| 2015/0185693 | A1 | 7/2015 | Wang et al. | |

* cited by examiner

PROCESS CARTRIDGE MODIFICATION AND METHOD FOR RETRACTABLE PROCESS CARTRIDGE DRIVE

CROSS REFERENCE TO RELATED APPLICATION

This application claims the benefit of and priority to U.S. provisional patent application No. 62/128,769, filed Mar. 5, 2015, the entire contents of which are hereby incorporated by reference herein.

BACKGROUND

The present disclosure relates to consumable cartridges used in image forming apparatuses, and more specifically to modifications and methods for making modifications to such cartridges to accommodate aftermarket cartridge drive components.

Aftermarket suppliers of imaging consumables, such as toner cartridges for imaging devices, configure their cartridges to be compatible with the drive mechanisms provided on name brand imaging devices. In many instances, suppliers of aftermarket consumable cartridges modify their cartridges to be different from original equipment manufacturer (OEM) cartridges, for example to increase page yield, to make cartridges compatible with additional or different imaging devices, to improve performance with other non-OEM components (such as toner), and the like.

Some aftermarket suppliers remanufacture OEM cartridges. These suppliers collect or otherwise acquire used OEM cartridges, disassemble, clean, and inspect the components, replace any parts that are damaged or worn beyond specified tolerances, and reassemble the components into a complete cartridge with a new supply of toner. Remanufactured cartridges offer many benefits, including a reduced cost compared to OEM cartridges and the diversion of waste material (i.e. the spent OEM cartridge) from the landfill. Like other aftermarket suppliers of imaging consumables, remanufacturers may modify the used cartridges they obtain or use parts configured differently from the OEM cartridge parts in order to obtain one or more of the benefits described above.

One example of an OEM cartridge that may be remanufactured in the manner discussed above is shown and described in U.S. Pat. No. 8,121,517 ("the '517 patent"), the entire contents of which are hereby incorporated by reference herein. The '517 patent discloses a process cartridge that may be mounted within a printer. With reference to FIGS. 1 and 2, which correspond to FIGS. 29 and 32, respectively, of the '517 patent, the cartridge includes a coupling member 150 that is pivotally mounted to the end of an organic photoconductive drum 20 rotatably supported within the cartridge. The coupling member 150 is mounted to the drum 20 using a ball-and-socket configuration, including spherical member 160 which functions as the ball and is received by a socket defined by a drum flange 151 mounted in the end of the drum 20. The coupling member 150 also includes a reduced diameter intermediate part 150*c* that extends away from the spherical member 160 and a driven portion 150*a* of relatively enlarged diameter and including force receiving portions 150*e* generally in the form of teeth or dogs configured to receive driving force from the printer.

The coupling member 150 extends through an opening in the side of the cartridge and is surrounded by what the '517 patent describes as a "regulating portion" 170. The regulating portion 170 functions to guide the cartridge into the printer and to limit the extent of pivotal movement of the coupling member 150 in various directions. According to the '517 patent, the regulating portion 170 includes a central opening defined in part by a first arcuate portion 170*a* through which intermediate part 150*c* of the coupling member 150 extends. The regulating portion 170 includes an inclination regulating portion 170*g* that permits angular movement generally in the rearward, downward, and forward directions within a predetermined range of around 20 to 30 degrees depending on the specific orientation of the coupling member 150.

The regulating portion 170 also includes a regulating projection 170*c* that projects in the axial direction a distance beyond the inclination regulating portion 170*g*. The regulating projection 170*c* extends over and above the first arcuate portion 170*a* and includes a flat surface portion 170*e* and a second arcuate portion 170*d* that cooperate to limit pivotal movement of the coupling member 150 in the upward and rearward directions to just a few degrees. The '517 patent refers to the position where the coupling member 150 is substantially axially aligned with the organic photoconductive drum to which it is attached as the "rotational force transmitting angular position." This position is associated with the cartridge being installed in the printer such that the coupling member 150 is positioned to receive driving rotational force from the printer drive mechanism. FIG. 2, which corresponds to FIG. 32 of the '517 patent, illustrates how the coupling member 150 moves from an angled or "pre-engagement angular position" as shown at (a) to the axially aligned rotational force transmitting angular position as shown at (d) as the cartridge is installed in the printer. When the cartridge is removed from the printer the coupling member 150 moves from the axially aligned rotational force transmitting angular position to the angled pre-engagement angular position. Pivotal movement of the coupling member 150 between these positions during insertion and removal of the cartridge facilitates engagement with and disengagement from the printer drive mechanism.

SUMMARY

In some aspects, a method of modifying a process cartridge includes obtaining a process cartridge including a guide member having a central body portion with an opening defining an axis and a regulating projection positioned substantially adjacent to the opening and extending axially from the central body, the regulating projection including an inner wall and an outer wall spaced radially outwardly from the inner wall, and eliminating the inner wall to increase a radial distance between the axis and the regulating projection.

The outer wall may be an outer arcuate wall arranged substantially concentrically with respect to the axis. The inner wall may include a flat surface portion and an arc portion arranged substantially concentrically with respect to the axis, and eliminating the inner wall may include eliminating the flat surface portion and the arc portion. The regulating portion may further include a joining wall extending between the arc portion and the outer arcuate wall, and the method may further include eliminating the joining wall. Eliminating the inner arcuate wall may include removing the inner wall from the guide member. The outer wall may include an inner arcuate surface facing the axis and having an inner arcuate surface radius, and removing the inner wall may include performing a cutting operation using a rotary cutter having a radius slightly less than the inner arcuate surface radius. Eliminating the inner arcuate wall may include replacing the guide member with a second guide member that does not include the inner wall. The method may further include installing an OPC drum into the process cartridge. The OPC drum may include a replacement gear and a replacement coupling member, and the replacement coupling member may be mounted for axial movement relative to the gear between an extended position and a retracted position. Installing the OPC drum into the process cartridge may include positioning the coupling member within the opening.

In other aspects, a method of modifying a process cartridge includes obtaining a process cartridge including a guide member having a central body portion with an opening defining an axis and a regulating projection positioned substantially adjacent to the opening and extending axially from the central body. The regulating projection includes an innermost arcuate portion spaced a radial distance from the axis. The method also includes modifying the guide member to increase the radial distance between the innermost arcuate portion of the regulating projection and the axis.

Before modifying the guide member the radial distance may be R1, and after modifying the guide member the radial distance may be R2. In some configurations, R2 may be at least about 20% greater than R1. In other configurations, R2 may be between about 20% and about 100% greater than R1. In still other configurations, R2 may be about 50% greater than R1. The regulating projection may include an outer arcuate wall arranged substantially concentrically with respect to the axis, and an inner wall including an arc portion arranged substantially concentrically with respect to the axis. Modifying the guide portion may include eliminating the inner wall. Before modifying the guide member the arc portion may define the innermost arcuate portion and after modifying the guide member an inner surface of the outer arcuate wall may defines the innermost arcuate portion. Modifying the guide member may include performing a cutting operation on the regulating portion. Modifying the guide member may also include replacing the guide member with a second guide member. The method may further include installing an OPC drum into the process cartridge. The OPC drum may include a replacement gear and a replacement coupling member, and the replacement coupling member may be mounted for axial movement relative to the gear between an extended position and a retracted position. Installing the OPC drum into the process cartridge may include positioning the coupling member within the opening.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limiting.

DETAILED DESCRIPTION

Figure 3:
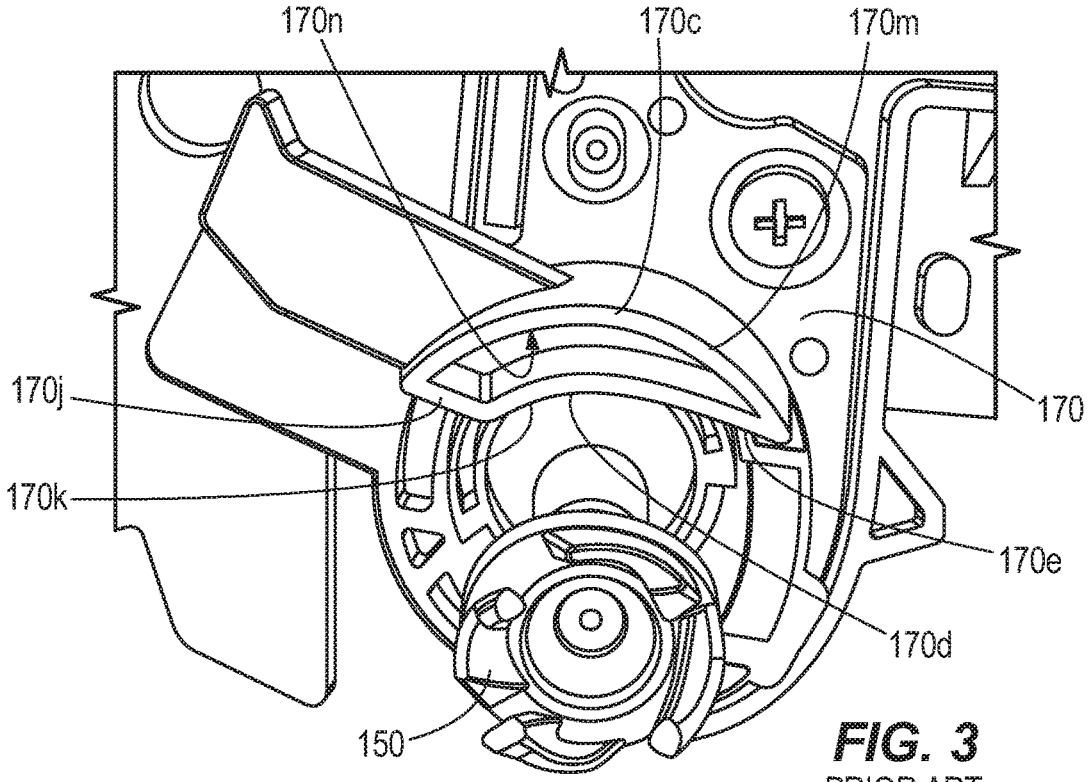
FIG. 3 PRIOR ART
FIG. 3 is a side view of a prior art cartridge coupling member and inclination regulating portion.

FIG. 3 illustrates one type of prior art regulating portion 170 that may be modified or replaced in accordance with the teachings of the present invention. Although other modifications may also be made, the primary modification associated with the present invention involves modification to the regulating projection 170*c* to provide additional clearance for coupling members that, unlike the prior art coupling member 150, generally do not pivot and/or are not inclinable relative to the axis of the drum 20. As shown in FIG. 3, the prior art regulating projection 170*c* includes an outer arcuate wall 170*m*, and an inner wall 170*k* comprising the flat surface portion 170*e* and second arc part 170*d* described above. The regulating projection 170*c* also includes a substantially straight joining wall 170*j* that extends between a rear edge of the second arc part 170*d* and a rear edge of the outer arcuate wall 170*m*. As discussed further below, modification of the illustrated regulating projection 170*c* includes removing the inner wall 170*k* and the joining wall 170*j*.

Figure 4:
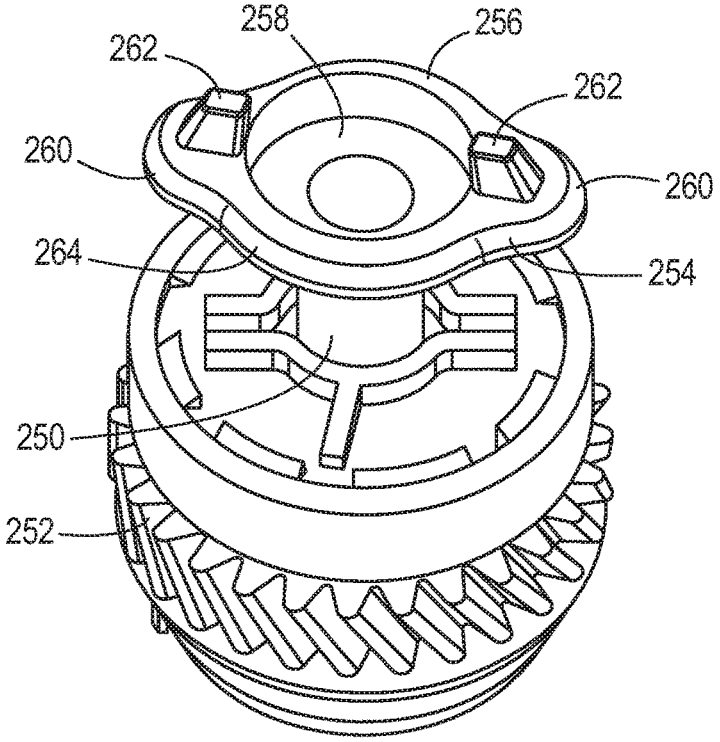
FIG. 4 is a perspective view of a replacement OPC drum gear and coupling member.

FIG. 4 illustrates a replacement coupling member 250 and gear 252 for installation into the end of an OPC drum 20 during remanufacturing of a cartridge. The illustrated coupling member 250 and gear 252 are disclosed in U.S. Pat. No. 9,170,549, the entire contents of which are hereby incorporated by reference herein. The coupling member 250 is mounted for axial movement relative to gear 252 between an extended position (shown in FIG. 4) and a retracted position and is biased toward the extended position. The coupling member 250 is also rotatable relative to the gear 252 through a rotation that is less than one rotation about the axis, after which further rotation of the coupling member 250 will cause rotation of the gear 252.

The coupling member 250 includes an engagement portion 254 configured for engagement with the drive mechanism of the printer. The engagement portion 254 includes a generally circular central portion 256 defining a circular recess 258, and a pair of diametrically opposed radial projections 260 extending outwardly from the central portion 256. The engagement portion 254 also includes a pair of axially extending drive lugs 262 for receiving driving force from the printer drive. The drive lugs 262 each include a radially inner edge substantially aligned with the outer edge of the circular recess 258, and a radially outer edge that is positioned along a respective one of the radial projections 260. A convex radius 264 extends continuously around the outer periphery of the engagement portion 254. The convex radius 264 is provided such that during installation of a cartridge including the coupling member 250, the convex radius 264 contacts the drive mechanism of the printer and causes the coupling member 250 to be urged in an axial direction toward the retracted position. Movement of the coupling member 250 toward the retracted position facilitates engagement of the engagement portion 254 with the drive mechanism of the printer.

It should be appreciated that the coupling member 250 of FIG. 4 is one example of a potential replacement for the pivoting coupling member 150 discussed above. Several other replacement coupling members have also been proposed, including coupling members that pivot to a far more limited degree than the coupling member 150, coupling members where only relatively small portions of the coupling member, such as the engagement portion, are able to pivot or incline relative to the drum axis, coupling members that are able to shift radially away from the drum axis without pivoting or with a relatively small amount of pivoting, and the like. These and other replacement coupling member configurations may all be combined with the teachings of the present invention to facilitate and/or improve engagement and disengagement of the replacement coupling member with the printer drive mechanism.

Referring now to FIGS. 5-8, a modified regulating portion 170*z* in the form of a guide member 300 is shown secured to one side of a process cartridge. The guide member 300 is heat staked and/or sonically welded to the process cartridge as at 304, but may also be secured to the process cartridge using screws, rivets, or other fastening methods. In the illustrated example the coupling member 250 is shown extending through the guide member 300 for engagement with the drive mechanism of a printer.

Figure 1A:
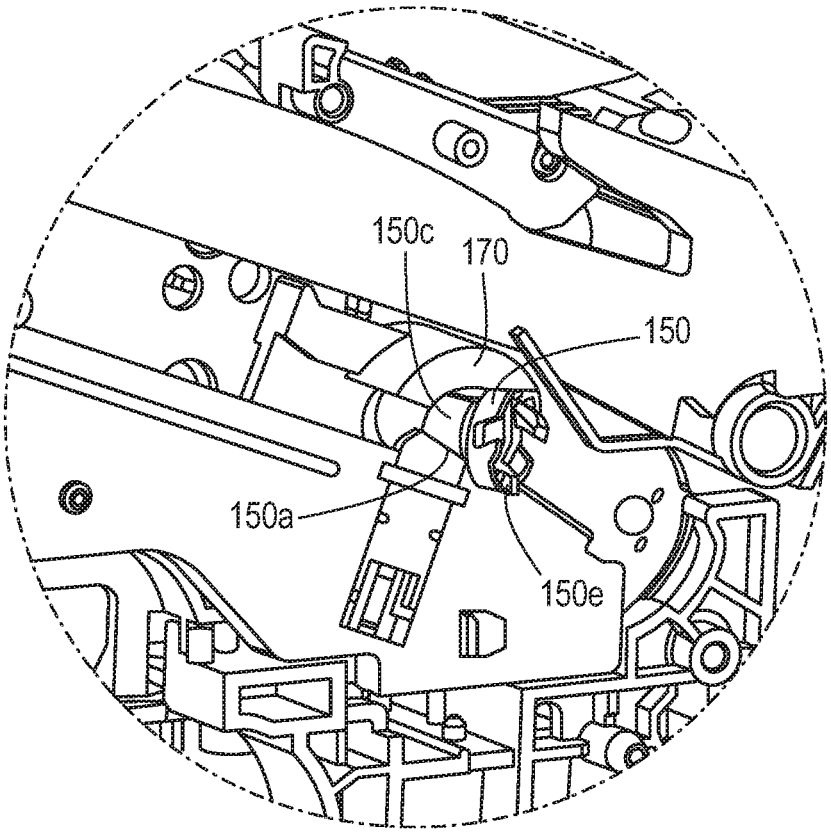
FIG. 1A PRIOR ART
FIG. 1 is a perspective view illustrating a relation between a main assembly guide of a prior art printer and a coupling of a prior art process cartridge.
Figure 1B:
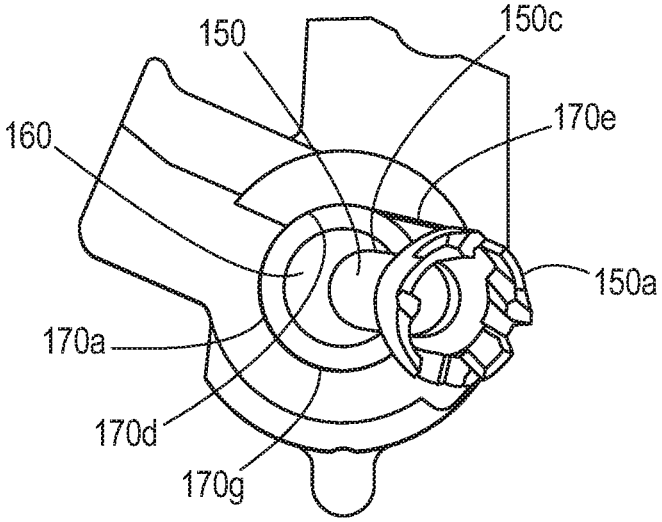
FIG. 1B PRIOR ART
Figure 2A:
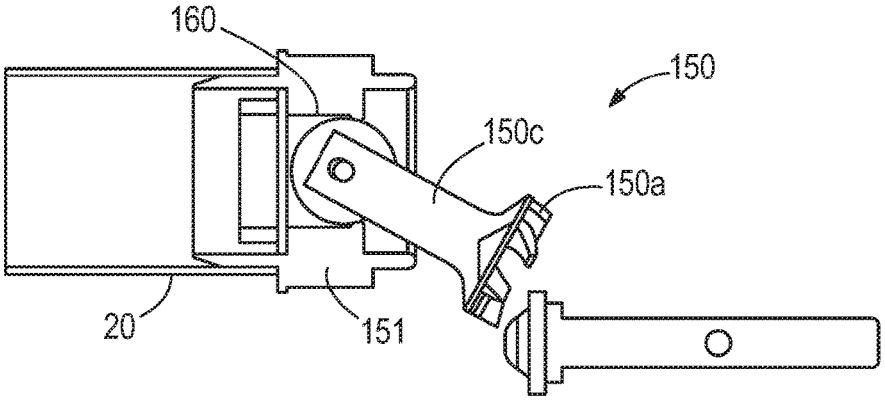
FIG. 2A PRIOR ART
FIG. 2 is a perspective view illustrating a process of the prior art coupling of FIG. 1 engaging a prior art driving shaft.
Figure 2B:
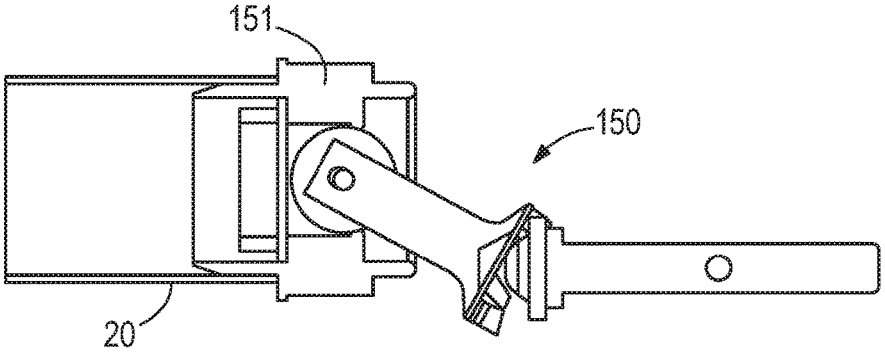
FIG. 2B PRIOR ART
Figure 2C:
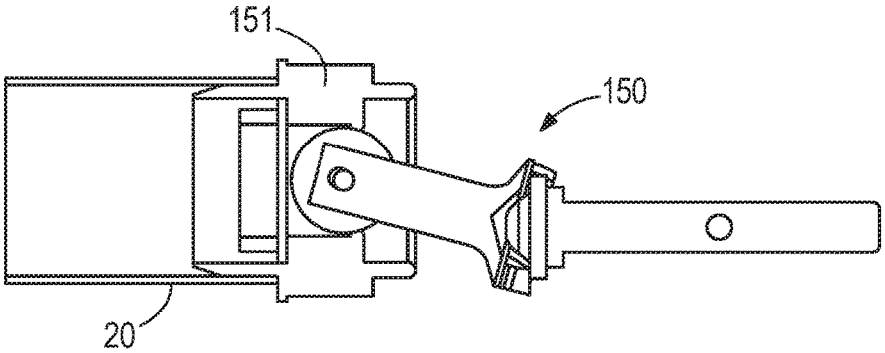
FIG. 2C PRIOR ART
Figure 2D:
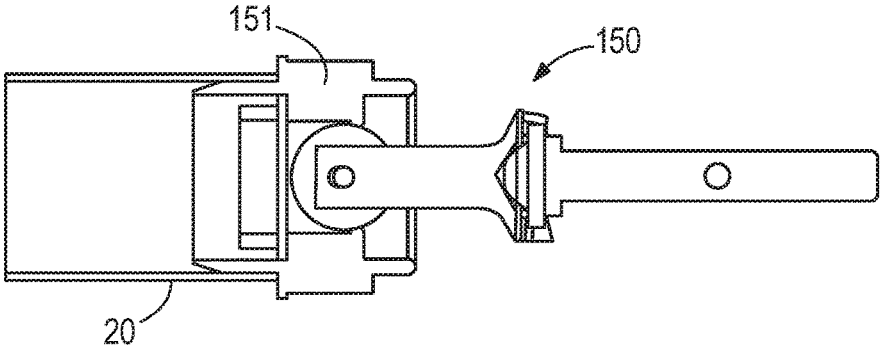
FIG. 2D PRIOR ART

The guide member 300 includes a central body portion 308 defining a generally circular opening 312 defining an axis 316. The opening includes at least one substantially arcuate portion 320 having a first radius R1. In the illustrated configuration shown, for example, in FIG. 1, the first radius R1 of the arcuate portion 320 substantially corresponds to a radius of the second arc part 170*d* of the inner wall 170*k*. A mounting wall 324 extends generally radially outwardly from the central body portion 308 and includes a mounting surface (not visible in FIGS. 5-8) that mates up with a side wall of the process cartridge when the guide member 300 is coupled to the process cartridge. The mounting wall 324 also defines at least one mounting aperture 328 that may be used to secure the guide member 300 to the process cartridge using one or more screws, rivets, heat stakes, sonic welding, bonding and the like. The guide member 300 also includes a guide wall 332 extending generally radially outwardly from the central body portion 308 and generally oriented at an acute included angle with respect to the mounting wall 324. The guide wall 332 includes at least one guide surface 336 that engages slots, grooves, or other features provided in the printer when the guide member 300 (attached to a process cartridge) is installed into the printer. In the illustrated construction the guide surface is oriented substantially perpendicular to the mounting surface of the mounting wall 324.

The guide member 300 also includes an overhanging portion 340 that, in the illustrated configuration, corresponds to a regulating projection 170*c* that has been modified such that substantially only the outer arcuate wall 170*m* remains. More specifically, the overhanging portion 340 may be formed by milling, trimming, cutting, melting, or otherwise removing the inner wall 170*k*, including both the flat surface portion 170*e* and second arc part 170*d*, as well as the straight joining wall 170*j* (see FIG. 3). As a result, the inner surface 170*n* of what was the inner wall 170*k* becomes an innermost arcuate surface 344 of the overhanging portion 340. The innermost arcuate surface 344 faces the axis 316 and has a second radius R2 that is greater than the first radius R1. In some configurations, the second radius R2 is at least about 20% greater than the first radius R1. In the illustrated configuration, the second radius R2 is about 12 mm and the first radius R1 is about 8 mm. Thus, in the illustrated configuration, the second radius R2 is about 50% greater than the first radius R1. To maintain printer compatibilities, it is preferred for the second radius R2 to be no more than about 100% greater than the first radius R1.

Figure 5:
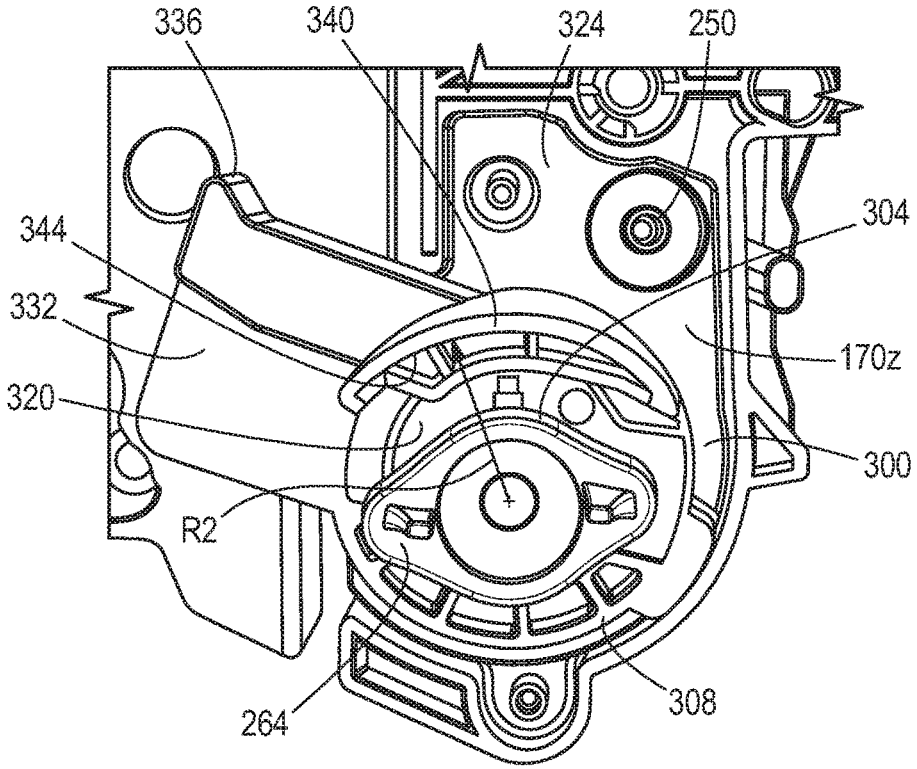
FIG. 5 is a side view of a portion of a process cartridge that has been modified in accordance with the present invention.
Figure 6:
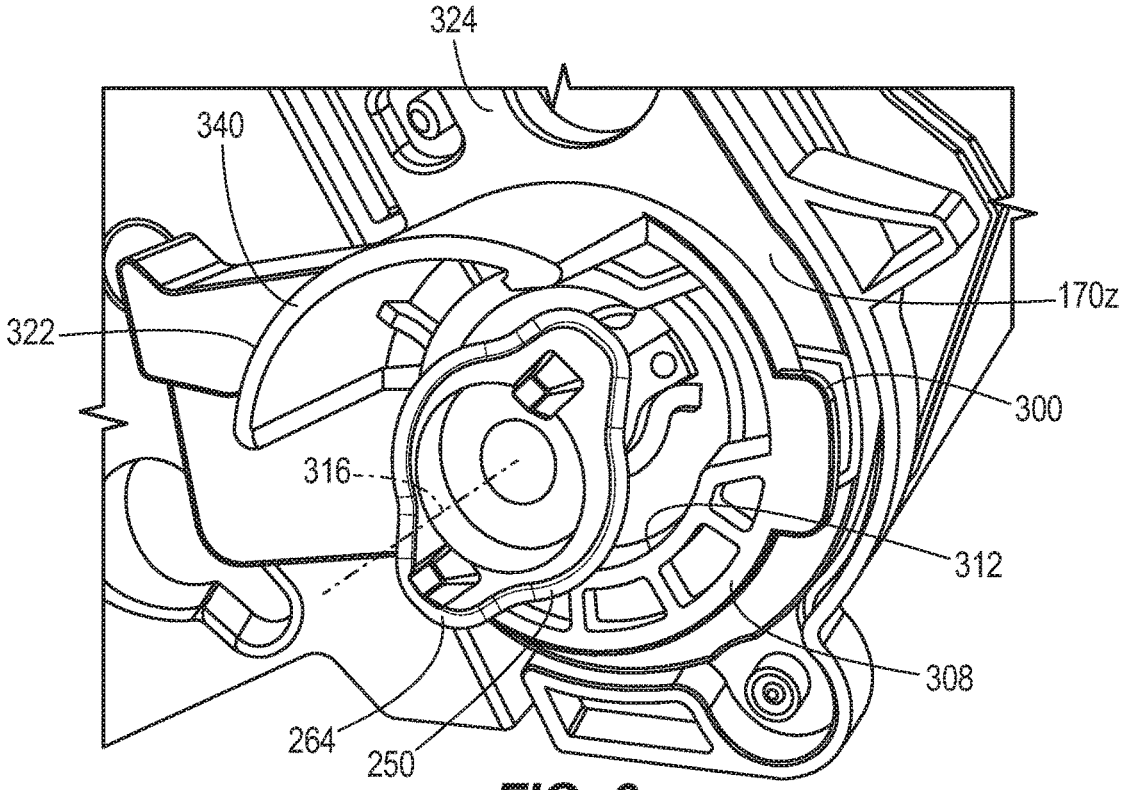
FIG. 6 is a perspective view of the portion of the modified process cartridge of FIG. 5.
Figure 7:
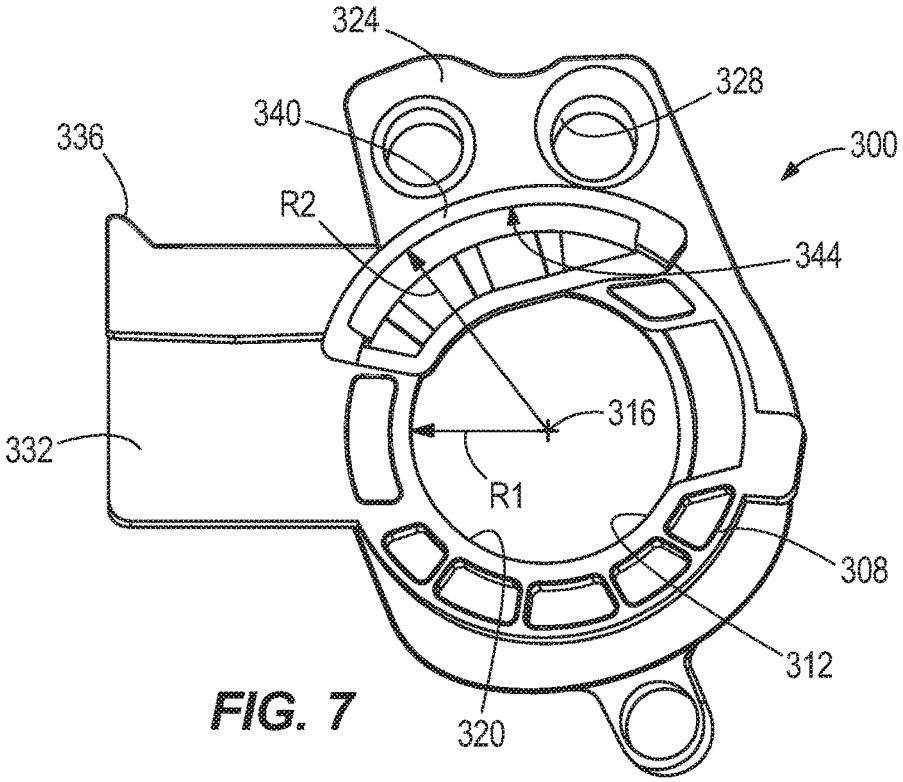
FIG. 7 is a side view of a modified guide member for a process cartridge.
Figure 8:
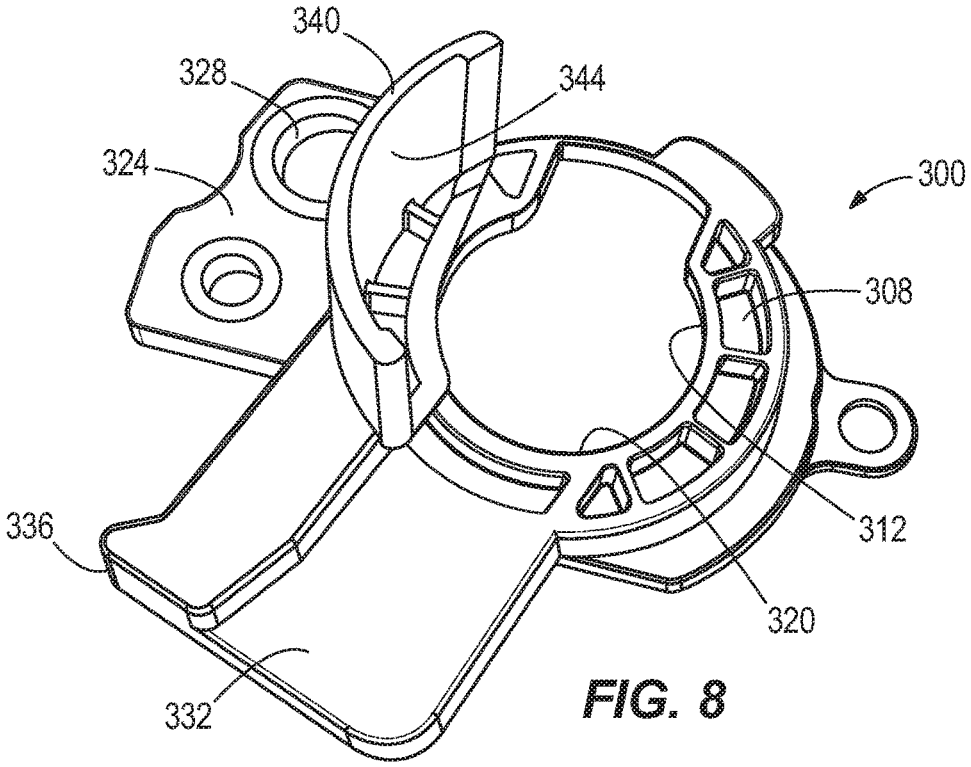
FIG. 8 is a perspective view of the modified guide member of FIG. 7.

As shown in FIGS. 5 and 6, there are several millimeters of clearance between the innermost arcuate surface 344 and the outermost portion of the convex radius 264 provided on the coupling member 250. Without the above described modification, clearance between the outermost portion of the convex radius 264 and the inner wall 170*k* of the regulating projection 170*c* is extremely close. Initial reasoning based upon, among other things, the teachings of the '517 patent, suggested that a relatively small clearance between the convex radius 264 and the inner wall 170*k* might facilitate engagement of the coupling member 250 with the printer drive mechanism, for example by preventing excessive deflection of the coupling member in the upward and rearward directions as used for the coupling member 150. However, the opposite was determined to be true. In many circumstances, particularly during installation and removal of the cartridge, the close clearance between the inner wall 170*k* and the convex radius 264 was found to be preventing the coupling member 250 from moving axially in the manner intended. By increasing the clearance surrounding the convex radius 264 operation of the coupling member 250 is unexpectedly improved.

In one preferred method of making the guide member 300, an axial cutter, such as an end mill, having an outer radius slightly less than (for example between about 0.5 mm and 5 mm less than) the radius R2 is selected such that a single axial cut may be used to remove the inner wall 170*k* and the straight joining wall 170*j* (see FIG. 3). In some configurations, additional joining walls may extend between the inner wall 170*k* and the outer wall 170*m* of the original regulating projection 170*c*. Using the above described method of making the guide member 300, these additional walls may also be removed in a single cutting operation. Another method of making the guide member 300 is to mold or otherwise fabricate a completely new guide member 300. In this method, the original regulating portion 170 may be removed from the process cartridge and recycled, and the new guide member 300 may be installed in its place. In still other methods of making the guide member 300, the regulating projection 170*c* may be removed in its entirety, including the outer wall 170*m*. These and other alternative constructions are intended to fall within the spirit and the scope of the present invention.

Various features of the invention are set forth in the following claims.

What is claimed is:

1. A method of modifying a process cartridge, the method comprising:

obtaining a process cartridge including a guide member having a central body portion with an opening defining an axis and a regulating projection positioned substantially adjacent to the opening and extending axially from the central body, the regulating projection including an inner wall and an outer wall spaced radially outwardly from the inner wall;

eliminating the inner wall to increase a radial distance between the axis and the regulating projection, and;

installing an OPC drum into the process cartridge, the OPC drum including a replacement gear and a replacement coupling member, the replacement coupling member being mounted for axial movement relative to the gear between an extended position and a retracted position.

2. The method of claim 1, wherein the outer wall is an outer arcuate wall arranged substantially concentrically with respect to the axis, wherein the inner wall includes a flat surface portion and an arc portion arranged substantially concentrically with respect to the axis, and wherein eliminating the inner wall includes eliminating the flat surface portion and the arc portion.

3. The method of claim 2, wherein the regulating portion further includes a joining wall extending between the arc portion and the outer arcuate wall, the method further comprising eliminating the joining wall.

4. The method of claim 1, wherein eliminating the inner arcuate wall includes removing the inner wall from the guide member.

5. The method of claim 4, wherein the outer wall includes an inner arcuate surface facing the axis and having an inner arcuate surface radius, and wherein removing the inner wall includes performing a cutting operation using a rotary cutter having a radius slightly less than the inner arcuate surface radius.

6. The method of claim 1, wherein eliminating the inner arcuate wall includes replacing the guide member with a second guide member that does not include the inner wall.

7. The method of claim 1, wherein installing the OPC drum into the process cartridge includes positioning the coupling member within the opening.

8. A method of modifying a process cartridge, the method comprising:

obtaining a process cartridge including a guide member having a central body portion with an opening defining an axis and a regulating projection positioned substantially adjacent to the opening and extending axially from the central body, the regulating projection including an innermost arcuate portion spaced a radial distance from the axis;

modifying the guide member to increase the radial distance between the innermost arcuate portion of the regulating projection and the axis; and, installing an OPC drum into the process cartridge, the OPC drum including a replacement gear and a replacement coupling member, the replacement coupling member being mounted for axial movement relative to the gear between an extended position and a retracted position.

9. The method of claim 8, wherein before modifying the guide member the radial distance is R1 , wherein after modifying the guide member the radial distance is R2 , and wherein R2 is at least about 20% greater than R1.

10. The method of claim 9, wherein R2 is between about 20% and about 100% greater than R1.

11. The method of claim 9, wherein R2 is about 50% greater than R1.

12. The method of claim 8, wherein the regulating projection includes an outer arcuate wall arranged substantially concentrically with respect to the axis, and an inner wall including an arc portion arranged substantially concentrically with respect to the axis, and wherein modifying the guide portion includes eliminating the inner wall.

13. The method of claim 12, wherein before modifying the guide member the arc portion defines the innermost arcuate portion and wherein after modifying the guide member an inner surface of the outer arcuate wall defines the innermost arcuate portion.

14. The method of claim 8, wherein modifying the guide member includes performing a cutting operation on the regulating portion.

15. The method of claim 8, wherein modifying the guide member includes replacing the guide member with a second guide member.

16. The method of claim 8, wherein installing the OPC drum into the process cartridge includes positioning the coupling member within the opening.

* * * * *